US008220108B2

(12) United States Patent
Oh et al.

(10) Patent No.: US 8,220,108 B2
(45) **Date of Patent: *Jul. 17, 2012**

(54) CLEANER APPARATUS

(75) Inventors: Jang-Keun Oh, Seo-Gu (KR); Min-Ha Kim, Gwangju (KR); Hyun-Il Lee, Gwangjin-gu (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1015 days.

This patent is subject to a terminal disclaimer.

(21) Appl. No.: 12/186,678

(22) Filed: Aug. 6, 2008

(65) Prior Publication Data

US 2009/0205156 A1 Aug. 20, 2009

(30) Foreign Application Priority Data

Feb. 18, 2008 (KR) ..... 10-2008-0014474

(51) Int. Cl.
*A47L 9/10* (2006.01)

(52) U.S. Cl. ..... 15/347; 15/383

(58) Field of Classification Search ..... 15/347, 15/383; *A47L 9/10*

See application file for complete search history.

(56) References Cited

U.S. PATENT DOCUMENTS 5,671,499 A 9/1997 Melito et al.

FOREIGN PATENT DOCUMENTS

| | | |
|---|---|---|
| DE | 10144129 | 6/2002 |
| JP | 2000-037331 | 2/2000 |
| JP | 2000-166826 | 6/2000 |

*Primary Examiner* — David Redding
(74) *Attorney, Agent, or Firm* — Blank Rome LLP

(57) ABSTRACT

A vacuum apparatus having a suction nozzle, an air suction unit to which the suction nozzle is pivotally connected and which fluidly communicates with the suction nozzle through a connection channel, a dirt receptacle which has at least two collecting parts fluidly communicating with at least two outlets formed at the air suction unit, respectively.

9 Claims, 6 Drawing Sheets

CLEANER APPARATUS

CROSS-REFERENCE TO RELATED APPLICATIONS

This application claims priority from Korean Patent Application No. 10-2008-14474, filed on Feb. 18, 2008, in the Korean Intellectual Property Office, the entire disclosure of which is hereby incorporated by reference.

BACKGROUND OF THE INVENTION

1. Field of the Invention

The present invention relates to a cleaner apparatus, and more particularly, to a cleaner apparatus which has a short connection channel between a cleaner body and a suction nozzle.

2. Description of the Related Art

In general, a vacuum cleaner uses a suction motor to generate a suction force to draw in air, including dust or dirt (hereinafter, referred to as 'dirt'). The suction motor of the vacuum cleaner is generally distally located from a dust collecting apparatus which separates and collects dirt from the drawn-in air. Accordingly, the dirt drawn in by the suction force of the suction motor is filtered from the air when passing through the dust collecting apparatus, and the filtered air passes through the suction motor and is discharged out of the vacuum cleaner.

Most commonly, a vacuum cleaner has an elongated channel between a suction nozzle, adjacent to the surface to be cleaned (referred to herein as "cleaning surface") and a suction motor located distal from the dust collecting apparatus. Therefore, the suction force of the suction motor does not act on the dirt on the cleaning surface directly.

Considering this drawback of a general vacuum cleaner, a power head type cleaner has been developed. However, such power head type cleaners have a suction nozzle fixed to a cleaner body, thereby requiring the cleaner to be rotated when cleaning hard-to-reach places, which is inconvenient for users. Also, rotating such a cleaner in a narrow space is difficult and thus, that space is often not satisfactorily cleaned.

SUMMARY OF THE INVENTION

Exemplary embodiments of the present invention overcome the above disadvantages and other disadvantages not described above. However, the present invention is not limited to overcoming the disadvantages described above, and particular exemplary embodiments of the present invention may not overcome some of the specific problems described above.

The foregoing and/or other aspects and utilities of the present invention may be achieved by a vacuum apparatus, having an air suction unit, a suction nozzle pivotally connected to the air suction unit, wherein the suction nozzle and the air suction unit fluidly communicate through a connection channel; and a dirt receptacle which has at least two collecting parts fluidly communicating with at least two outlets formed at the air suction unit, respectively.

The suction nozzle of the present invention is commonly aligned along an advancing direction of the vacuum apparatus, if no external force is applied to the suction nozzle.

The air suction unit includes a base and a housing seated on the base connected to the connection channel, wherein at least two outlets are formed at the housing. An impellor is disposed inside the housing, and an impellor motor is disposed outside the housing to rotate the impellor.

A rear end of the suction nozzle, a middle end of the base and the housing, may be elastically hinged to each other by an elastic member, such as a torsion spring. The connection channel may be connected to a middle portion of the housing.

The connection channel may be a flexible hose which maintains the same channel cross section when the suction nozzle pivots. The flexible hose may be formed in a telescopic configuration.

The suction nozzle may include a rotary brush which is rotatably disposed at a dirt suction inlet. The rotary brush may be rotated by a brush motor disposed in the suction nozzle.

The foregoing and/or other aspects and utilities of the present invention may also be achieved by a cleaner apparatus which includes a cleaner apparatus comprising a suction nozzle, a dirt receptacle which fluidly communicates with the suction nozzle through a connection channel, and an air suction unit which fluidly communicates with a discharge outlet of the dirt receptacle, wherein the suction nozzle is pivotally connected to the air suction unit. The connection channel is formed of a flexible hose, in a telescopic configuration.

The suction nozzle and the air suction unit may be elastically hinged to each other by an elastic member.

The suction nozzle may include a rotary brush which is rotatably disposed at a dirt suction inlet. The rotary brush may be rotated by a brush motor located in the suction nozzle.

The foregoing and/or other aspects and utilities of the present invention may also be achieved by a stick type vacuum cleaner including a cleaner body, a stick handle which is disposed at the cleaner body, a cleaner apparatus having a suction nozzle disposed on the cleaner body, an air suction unit to which the suction nozzle is pivotally connected and which fluidly communicates with the suction nozzle through a connection channel, and a dirt receptacle which has at least two collecting parts fluidly communicating with at least two outlets formed at the air suction unit, respectively. The suction nozzle is aligned along an advancing direction of the vacuum cleaner when no external force is applied to the suction nozzle.

The stick handle may be folded, at least one time, or may be formed in a telescopic configuration such that the stick handle is adjustable in length.

The foregoing and/or other aspects and utilities of the present invention may be also achieved by a stick type vacuum cleaner including a cleaner body, a stick handle which is disposed at the cleaner body, and a cleaner apparatus which is disposed on the cleaner body, wherein the cleaner apparatus includes a suction nozzle, a dirt receptacle which fluidly communicates with the suction nozzle through a connection channel, and an air suction unit which fluidly communicates with a discharge outlet of the dirt receptacle. The suction nozzle is pivotally connected to the air suction unit. The connection channel is formed of a flexible hose. The suction nozzle and the air suction unit are elastically hinged to each other by an elastic member.

Since the suction nozzle is elastically pivotable, a cleaning operation can be easily performed in a hard-to-reach place. A suction channel area is constantly maintained even if a pivoting angle of the suction nozzle changes and thus, a suction force reduction due to a pressure loss can be prevented and dirt suction efficiency can be maximized with lower power consumption.

BRIEF DESCRIPTION OF THE DRAWINGS

Above and other aspects of the present invention will become apparent and more readily appreciated from the following description of the exemplary embodiments, taken in conjunction with the accompany drawings of which.

DETAILED DESCRIPTION OF EXEMPLARY EMBODIMENTS

Figure 1:
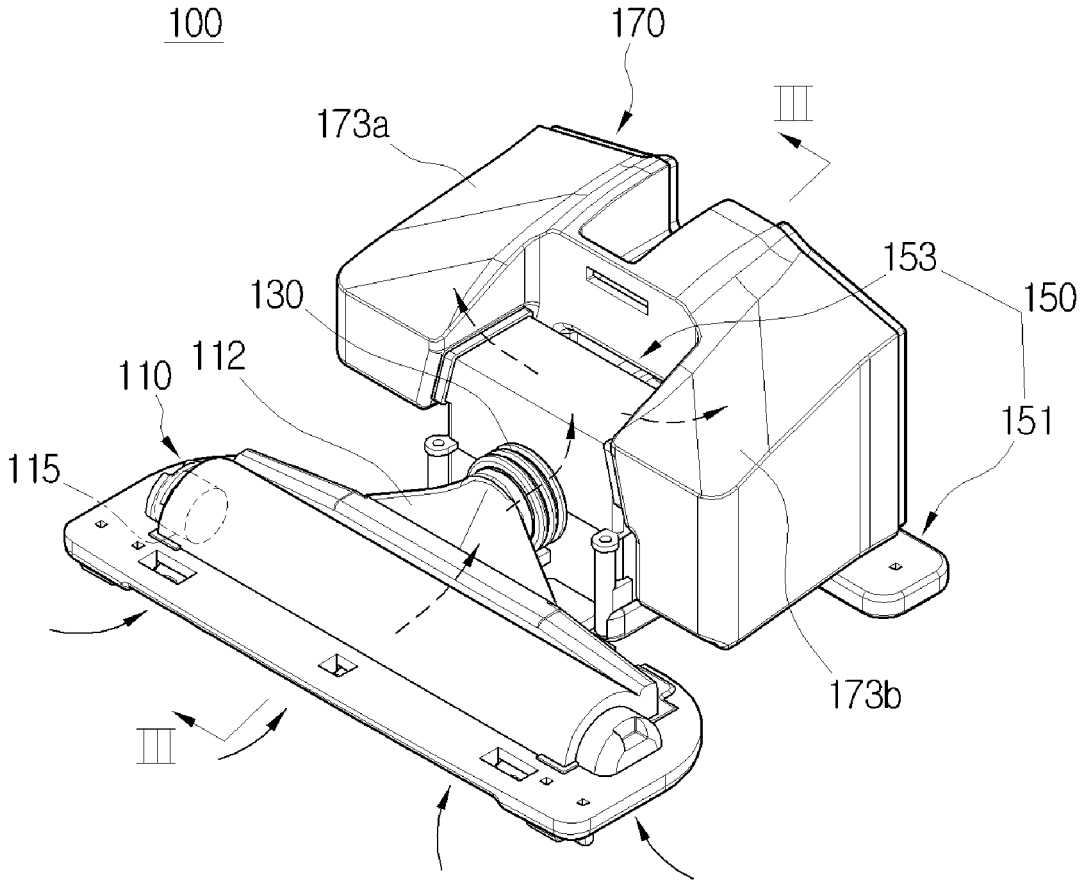
FIG. 1 is a perspective view illustrating a cleaner apparatus in an assembled state according to a first exemplary embodiment of the present invention.

Certain exemplary embodiments of the present invention will be described in great detail with reference to the accompanying drawings.

In the following description, the same drawing reference numerals are used for the same elements even in different drawings. The matter defined in the description, such as detailed construction and elements, are provided to assist in a comprehensive understanding of the invention. Thus, it is apparent that the exemplary embodiments of the present invention can be carried out without this specifically defined matter. Also, well-known functions or constructions are not described in detail since they would obscure the invention with unnecessary detail.

Figure 2:
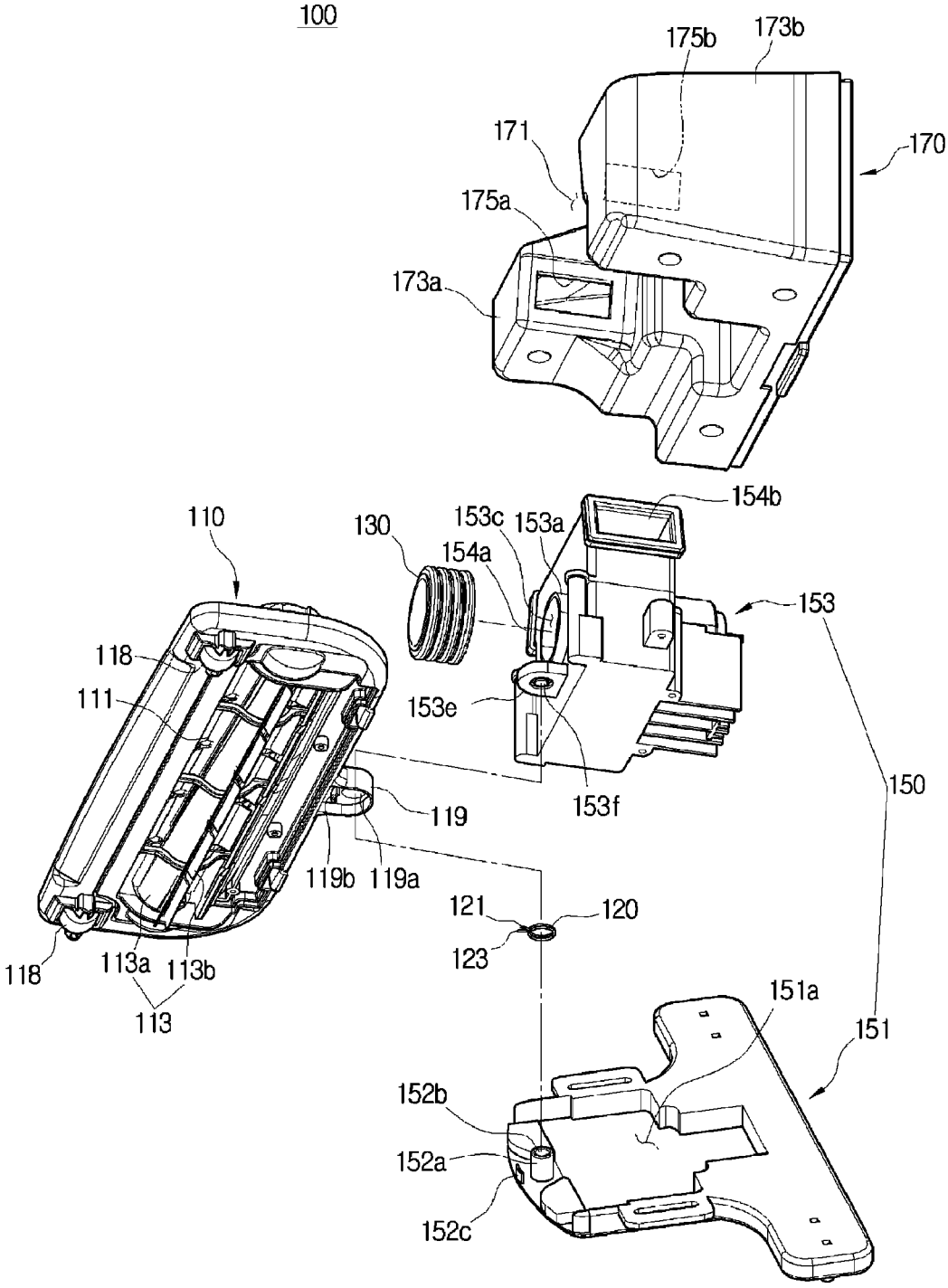
FIG. 2 is an exploded perspective view illustrating the cleaner apparatus according to the first exemplary embodiment of the present invention.
Figure 3:
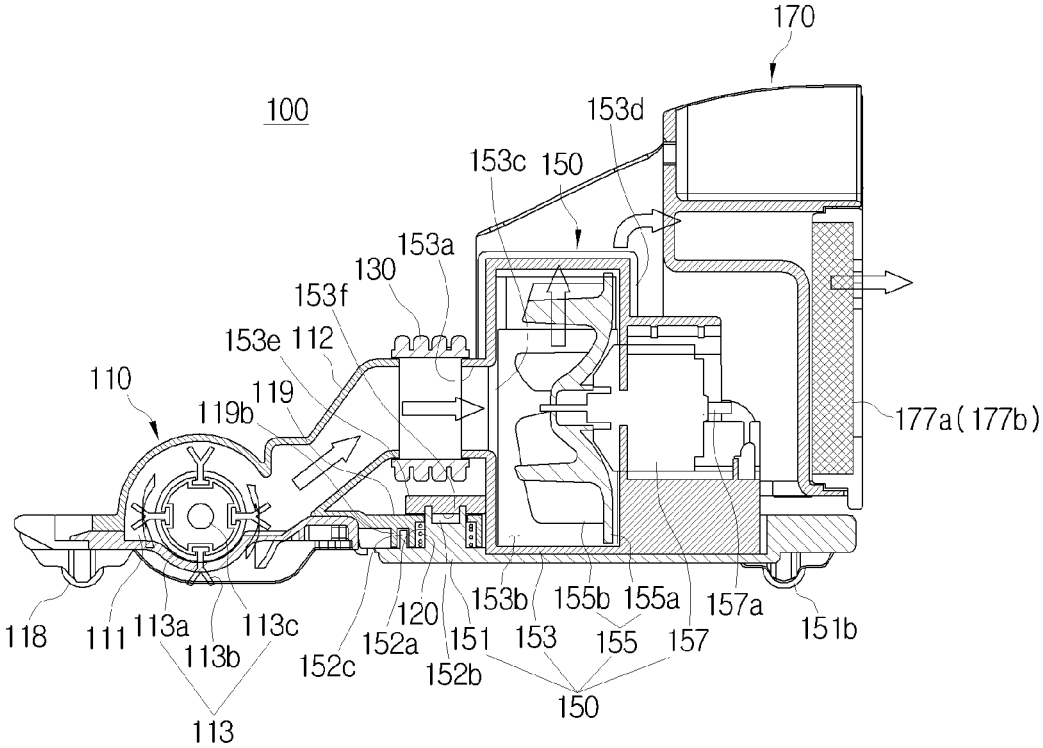
FIG. 3 is a cross section view taken along line III-III of FIG. 1.

Hereinafter, a cleaner apparatus according to a first exemplary embodiment of the present invention will be described in detail with reference to FIGS. 1 to 3. FIGS. 1 and 2 are an assembly perspective view and an exploded perspective view illustrating a cleaner apparatus according to a first exemplary embodiment of the present invention, respectively, and FIG. 3 is a cross section view taken along line III-III of FIG. 1.

An aspect of the present invention is to provide a cleaner apparatus which is capable of easily performing a cleaning operation in a narrow or hard-to-reach place.

Another aspect of the present invention is to provide a cleaner apparatus which is capable of maximizing dirt suction efficiency with low power consumption.

Still another aspect of the present invention is to provide a cleaner apparatus which has a suction nozzle having a variable pivoting angle and is capable of maintaining a constant channel area even when the suction nozzle changes its pivoting angle, thus, preventing a pressure loss.

Referring to FIGS. 1 to 3, a cleaner apparatus 100 according to a first exemplary embodiment of the present invention includes a suction nozzle 110, a connection channel 130, an air suction unit 150, and a dirt receptacle 170.

The suction nozzle 110, which draws in dirt from a cleaning surface may have a dirt suction port 111 facing the cleaning surface and a first connection part 119 protruding from the suction nozzle 110 to connect the suction nozzle 110 to the air suction unit 150. A rotary brush 113 may be rotatably disposed in the dirt suction port 111 and a brush motor 115 may also be disposed in the dirt suction port 111 to directly drive the rotary brush 113.

The rotary brush 113 may include a rotary drum 113*a* and a plurality of brush ribs 113*b* arranged on a surface of the rotary drum 113*a*. As the rotary brush 113 rotates, the brush ribs 113*b* scatter dirt from the cleaning surface and thus the dirt rises toward a lead-in channel 112. Also, the suction nozzle 110 may include a pair of wheels 118 formed at front opposite sides of a bottom thereof to smoothly travel along the cleaning surface.

The first connection part 119 may be disposed at a rear middle portion of the suction nozzle 110 and may have an inner space into which an elastic member, e.g. a torsion spring 120, is inserted. A penetrating hole 119*a* may be formed on an upper portion of the first connection part 119 to allow a hinge shaft 152*a* of a base 151 to be inserted therein. The first connection part 119 may have a first supporting protrusion 119*b* protruding therefrom downward to support one side 121 of the torsion spring 120.

The connection channel 130 connects the suction nozzle 110 and the air suction unit 150. More specifically, the connection channel 130 has one end connected to the lead-in channel 112 of the suction nozzle 110 and the other end connected to a cylindrical connection protrusion 153*a* of a housing 153. In this case, the connection channel 130 may be located at a center of the air suction unit 150 to correspond to a rotary shaft 157*a* of an impeller motor 157. To this end, pivotal movement of the suction nozzle 110 can be easily achieved. The connection channel 130 may be a flexible hose and may be formed in a substantially telescopic configuration and is constantly maintained even when the suction nozzle 110 pivots with respect to the air suction unit 150 by a predetermined angle due to an external force, so that a pressure loss can be prevented.

The air suction unit 150 may be disposed at a position substantially corresponding to a center of the suction nozzle 110 in a lengthwise direction of the suction nozzle 110. That is, the air suction unit 150 may be disposed at a rear portion of the suction nozzle 110, and, in this case, is aligned along an advancing direction of the cleaner apparatus 100 if the suction nozzle 110 is not subject to an external force.

The air suction unit 150 may include the base 151, the housing 153, an impellor 155, and the impellor motor 157. The base 151 may have a recess 151*a* formed on a top surface thereof to receive the housing 153 and has a pair of wheels 151*b* disposed at rear opposite sides of a bottom. Also, the base 151 may have a hinge shaft 152*a* protruding upwardly from a middle portion of a leading end of the base 151, and a hinge recess 152*b* may be formed on an upper end of the hinge shaft 152*a*. A second supporting protrusion 152*c* is formed on the leading end of the base 151 adjacent to the hinge shaft 152*a* to support the other end 123 of the torsion spring 120. As described, the hinge shaft 152*a* serves as a rotation axis of the suction nozzle 110.

The housing 153 has a space 153*b* therein to allow the impellor 155 to rotate in the housing 153. The space 153*b* defines a transfer path through which the dirt and air drawn in from the cleaning surface traverse. The housing 153 may be designed such that the impellor 155 discharges the dirt and the air drawn in the space 153*b* through an inlet 153*c* to first and second discharge outlets 154*a*, 154*b*. In this configuration, the first and the second discharge outlets 154*a*, 154*b* may be symmetrical with respect to the driving shaft 157*a* of the impellor motor 157. Although in this embodiment the housing 153 has two discharge outlets 154*a*, 154*b*, two or more discharge outlets may be formed in the housing 153, if necessary, wherein the two or more discharge outlets may fluidly communicate with two or more corresponding dirt receptacles 170.

A second connection part 153*e* protrudes from a middle portion of a front surface of the housing 153. The second connection part 153*e* may have an insertion protrusion 153*f* formed on a bottom thereof to be hingedly inserted into the hinge recess 152*b* of the hinge shaft 152*a*. Accordingly, the suction nozzle 110 is connected with the air suction unit 150 by the first connection part 119, the hinge shaft 152*a*, and the second connection part 153*e* and is pivotable by a predetermined angle.

The impellor 155 may be connected to the driving shaft 157*a* of the impellor motor 157 and discharges the drawn-in dirt and air to the dirt receptacle 170 by rotating. In this embodiment, the impellor 155 may include a rotary plate 155*a* connected to the driving shaft 157*a* of the impellor motor 157 and a plurality of wings 155*b* arranged on the rotary plate 155*a*. The plurality of wings 155*b* may be arranged on the rotary plate 155*a* at predetermined intervals in a radial direction. A level of noise of the impellor 155 and a flux amount of air drawn-in by the impellor 155 change depending on the number of wings 155*b*, and, it is therefore preferable to provide 4 to 6 wings 155*b* in consideration of this condition.

The impellor motor 157 may be disposed outside the housing 153, i.e. on a rear surface 153*d* of the housing 153, to be partitioned from the space 153*b* of the housing 153. The driving shaft 157*a* of the impellor motor 157 protrudes toward the space 153*b* of the housing 153 where the impellor 155 is disposed at one end. Accordingly, as the impellor motor 157 rotates, the impellor 155 rotates and generates a suction force. Due to this suction force, the dirt is drawn in the space 153*b* of the housing 153 from a cleaning surface along with the air. Because the impellor motor 157 is disposed on the rear surface 153*d* of the housing 153, the dirt and air drawn in by the impellor 155 does not pass the impellor motor 157. That is, the dirt and air drawn in by the impellor 155 bypasses the impellor motor 157 and are collected in the dirt receptacle 170.

The dirt receptacle 170 may have a receiving depression 171 formed in a middle portion thereof to receive the housing 153 such that the dirt receptacle 170 encloses the rear portion of the impellor motor 157. First and second collecting parts 173*b*, 173*b* may be symmetrically disposed at opposite sides of the receiving depression 171. The first and second collecting parts 173*a*, 173*b* have inlets 175*a*, 175*b* facing the receiving depression 171 and fluidly communicating with the first and the second discharge 154*a*, 154*b* of the housing 153. The dirt discharged from the first and second discharge outlets 154*a*, 154*b* progress down and pile up in the first and the second collecting parts 173*a*, 173*b* due to their weight.

First and second filters 177*a*, 177*b* may be disposed at rear portions of the first and the second collecting parts 173*a*, 173*b*. The air discharged from the first and the second discharge outlets 154*a*, 154*b* of the housing 153, along with the dirt, are discharged to the outside through the first and the second filters 177*a*, 177*b*. Accordingly, minute dirt particles, such as dust, which have not dropped down to the first and second collecting parts 173*a*, 173*b* remain in the air and are separated from the air by the first and the second filters 177*a*, 177*b*.

The cleaner apparatus 100 according to the first exemplary embodiment of the present invention may include a power supply unit (not shown) for supplying power to the brush motor 115, the impellor motor 157 and a controller for controlling the brush motor 115 and the impellor motor 157. The power supply unit may use a battery mounted in the cleaner apparatus 100 or a supply voltage separately provided. If the cleaner apparatus 100 uses a supply voltage, the cleaner apparatus 100 has a power cord (not shown) to be connected to the supply voltage. The controller is similar to a controller used in a conventional cleaner and thus a detailed description will be omitted.

Hereinafter, operation of the cleaner apparatus 100 according to the first exemplary embodiment of the present invention will be described in detail with reference to FIGS. 1 to 3.

When power is supplied to the brush motor 115 and the impellor motor 157, the rotary brush 113 and the impellor 155 rotate. When the rotary brush 113 rotates, the brush ribs 113*b* of the rotary brush 113 scatter dirt in contact with the cleaning surface such that the dirt rises toward the lead-in channel 112.

When the impellor 155 rotates, the dirt which has been separated from the cleaning surface by the rotary brush 113 passes through the lead-in channel 112 and the connection channel 130 in sequence along with the air, and then enters the inlet 153*c* of the housing 153. The dirt and air entering the space 153*b* of the housing 153 through the inlet 153*c* are discharged toward the first and the second discharge outlets 154*a*, 154*b* of the housing 153 due to centrifugal force generated by the rotation of the impellor 155. At this time, some of the dirt collides with the plurality of wings 155*b* of the impellor 155 and is discharged through the first and the second discharge outlets 154*a*, 154*b* due to an impact force. In this configuration, compared to a housing having a single discharge outlet, noise is reduced as the dirt and the air are distributed and discharged through the discharge outlets 154*a*, 154*b*.

The dirt and air discharge through the first and second discharge outlets 154*a*, 154*b* are lead into the inlets 175*a*, 175*b* of the first and the second collecting parts 173*a*, 173*b*. The dirt which progresses into the first and second collecting parts 173*a*, 173*b* drops down to and piles up on the bottom of the first and the second collecting parts 173*a*, 173*b* due to its weight, while the air is discharged to the outside through the first and the second filters 177*a*, 177*b*.

As described above, in the cleaner apparatus according to the first exemplary embodiment of the present invention, the drawn-in air and dirt do not pass through the impellor motor 157 and instead pass through the space 153*b* of the housing 153 where the impellor 155 is disposed. Therefore, because the suction force generated by the impellor motor 157 directly acts on the dirt on the cleaning surface, a cleaning operation can be more effectively performed even if the impellor motor 157 has a smaller capacity than that of a suction motor of a conventional vacuum cleaner, and therefore power consumption can be reduced.

Figure 4:
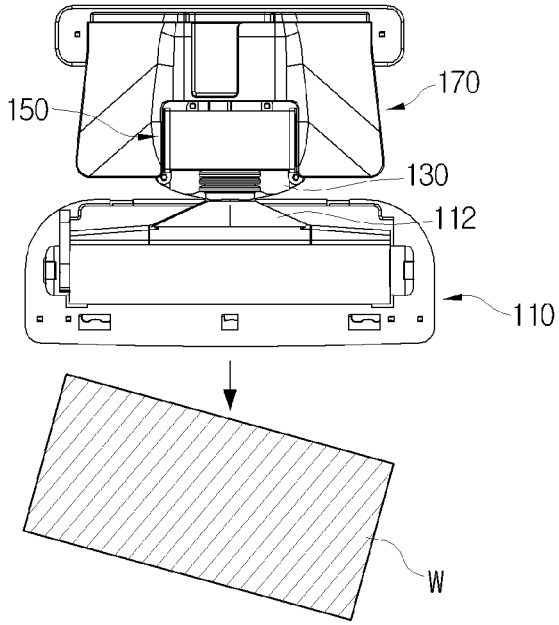
FIGS. 4 to 6 are plan views illustrating pivoting and recovering operations of a suction nozzle of the cleaner apparatus of FIG. 1 in sequence.
Figure 5:
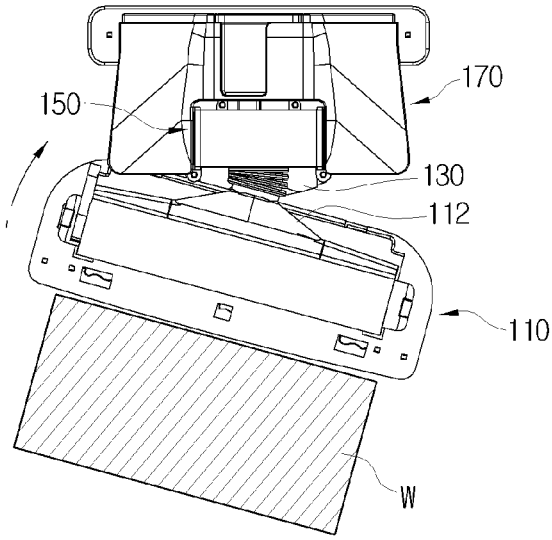

Also, when the cleaner apparatus 100 cleans a corner which is bounded between a wall W and a floor, using the suction nozzle 110, as shown in FIG. 4, the cleaner apparatus 100 can be advanced toward the wall W. At this time, an external force is applied to one side of the suction nozzle 110, being subjected to the external force, which therefore, pivots about the hinge shaft 152*a* (see FIG. 2) toward the air suction unit 150 by a predetermined angle. The suction nozzle 100 is elastically pivoted due to the torsion spring 120.

Figure 6:
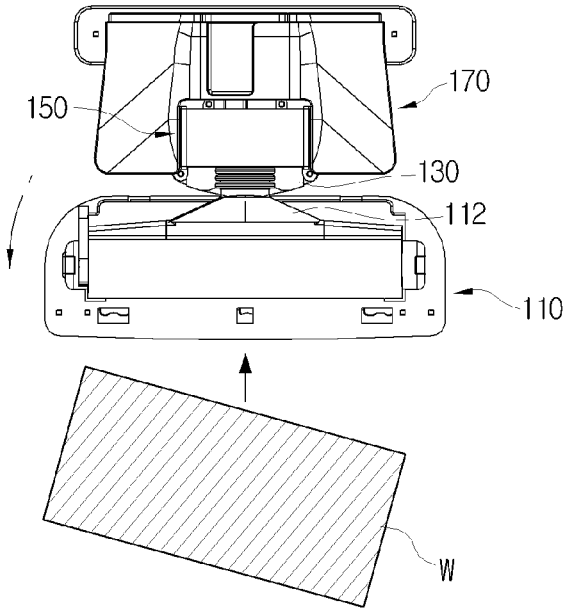

When the cleaner apparatus 100 is withdrawn from the wall W, as shown in FIG. 6, the side of the suction nozzle 110 pressed against the wall W pivots about the hinge shaft 152*a* and returns to its original position due to a recovering force of the torsion spring 120.

As described above, the suction nozzle 110 is pivotable to the right and the left about the hinge shaft 152*a* with respect to the air suction unit 150. Accordingly, even if there is an obstacle, such as a wall W or a leg of a table, on a cleaning surface, or there is a hard-to-reach place, the user is not required to pivot the entire cleaner apparatus 100. Cleaning is thus easier using the elastically pivotable suction nozzle 110.

Also, according to the first exemplary embodiment, because the suction nozzle 110 is pivotable, the area within of the connection channel 130 is not reduced and is constantly maintained. Preferably, the connection channel 130 is a flexible hose of a telescopic configuration. Therefore, a pressure loss can be prevented.

A cleaner apparatus 200 according to a second exemplary embodiment of the present invention will now be described in detail with reference to FIG. 7. The cleaner apparatus 200 according to the second exemplary embodiment of the present invention has the same suction nozzle 210 as that of the cleaner apparatus 100 of the first exemplary embodiment of the present invention, and thus its descriptions will be omitted. Also, the cleaner apparatus 200 according to the second exemplary embodiment has the same connection configuration between the suction nozzle 210 and an air unit 250 as that of the cleaner apparatus 100 of the first exemplary embodiment, except for that it omits a part corresponding to the second connection part 153*e* of the cleaner apparatus 100 of the first exemplary embodiment.

Figure 7:
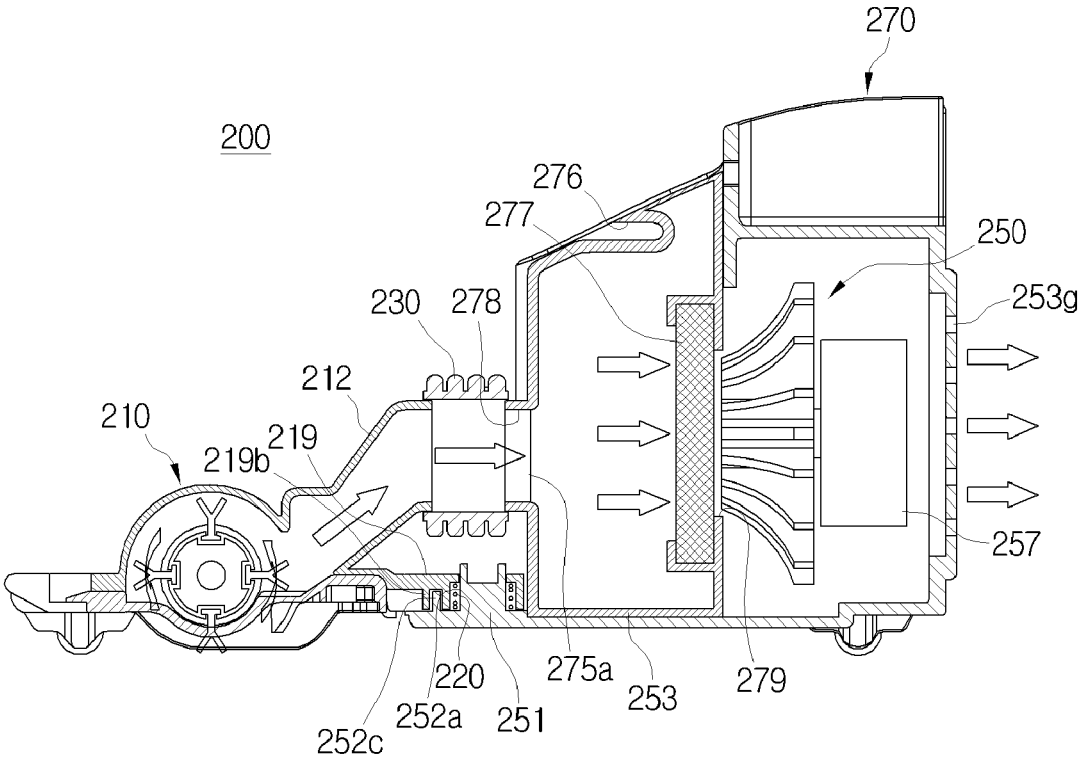
FIG. 7 is a cross section view illustrating a cleaner apparatus according to a second exemplary embodiment of the present invention.

Referring to FIG. 7, the cleaner apparatus 200 according to the second exemplary embodiment includes the suction nozzle 210, a connection channel 230, an air suction unit 250, and a dirt receptacle 270.

The air suction unit 250 may include a base 251, a housing 253, and a suction motor 257. The dirt receptacle 270 may be located on a front top surface of the base 251 and the housing 253 may be seated on a rear top surface of the base 251. A hinge shaft 252*a* protrudes from a middle portion of a leading end of the base 251 and a second supporting protrusion 252*c* is formed on a leading end of the base 251 adjacent to the hinge shaft 252*a* to support the other side of a torsion spring 220. In this case, one side of the torsion spring 220 is supported by a first supporting protrusion 219*b*.

A suction motor 257 may be disposed inside the housing 253 that draws in air which has been filtered. The air is discharged from a discharge outlet 279 of the dirt receptacle 270 toward a discharge grill 253*g* disposed on a surface of the housing 253.

The dirt receptacle 270 has an inlet 275*a* to lead in dirt and air flowing through an lead-in channel 212 of the suction nozzle 210 and a connection protrusion 278 formed around the inlet 275*a* and connected to one side of the connection channel 230. The connection channel 230 may be a flexible hose of a telescopic configuration and may be located at a position corresponding to a hinge connection configuration between the suction nozzle 210 and the air suction unit 250 for a smooth pivotal movement of the suction nozzle 210.

Also, the dirt receptacle 270 may have the discharge outlet 279 disposed at a position corresponding to a leading end of the suction motor 257. A filter 277 may be disposed at the discharge outlet 270 to filter minute dirt such as dust to protect the suction motor 257. Furthermore, a grip portion 276 may be formed on an upper portion of the dirt receptacle 270 to allow the user to draw out the dirt receptacle 270.

The cleaner apparatus 200 according to the second exemplary embodiment of the present invention employs the suction motor 257 to draw in dirt, which differs from the cleaner apparatus 200 of the first exemplary embodiment. Accordingly, a suction channel for the air passes through the suction nozzle 210 and the connection channel 230 in sequence and then passes through the dirt receptacle 270 and reaches the suction motor 257.

Like the cleaner apparatus 100 of the first exemplary embodiment, in the cleaner apparatus 200 according to the second exemplary embodiment of the present invention, the suction nozzle 210 is elastically hinged to the air suction unit 250 and is pivotable with respect to the air suction unit 250 so that it can perform a cleaning operation in a hard-to-reach place.

Figure 8:
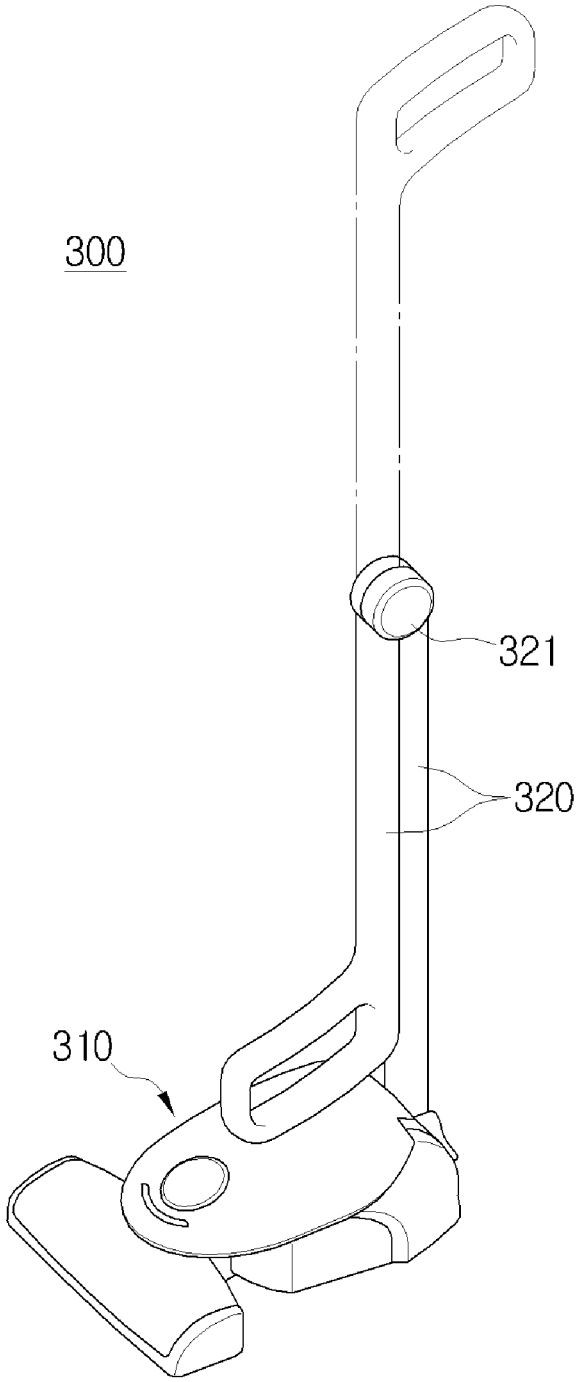
FIG. 8 is a cross section view illustrating a stick type cleaner according to a third exemplary embodiment of the present invention.

FIG. 8 illustrates a cleaner 300 using the cleaner apparatus 100, 200 according to the first and the second exemplary embodiments of the present invention by way of an example. Referring to FIG. 8, the cleaner 300 includes a cleaner body 310, where the cleaner apparatus 100, 200 according to the first and the second exemplary embodiments is disposed, and a stick handle 320 to manipulate the cleaner body 310.

In this embodiment, the stick handle 320 may have a hinge portion 321 formed at a center portion thereof. Therefore, the cleaner 300 may be folded with respect to the hinge portion 321 and is easy to store when not in use. The stick handle 320 may be fabricated in a telescopic configuration.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A cleaner apparatus comprising:

an air suction unit;

a suction nozzle pivotally connected to the air suction unit, wherein the suction nozzle and the air suction unit fluidly communicate through a connection channel; and a dirt receptacle which has at least two collecting parts fluidly communicating with at least two outlets formed at the air suction unit, respectively.

2. The cleaner apparatus as claimed in claim 1, wherein the suction nozzle is aligned along an advancing direction of the cleaner apparatus when no external force is applied to the suction nozzle.

3. The cleaner apparatus as claimed in claim 2, wherein the air suction unit comprises:

a base;

a housing seated on the base and connected to the connection channel, the at least two outlets being formed at the housing;

an impellor disposed inside the housing; and an impellor motor disposed outside the housing to rotate the impellor.

4. The cleaner apparatus as claimed in claim 3, wherein a rear end of the suction nozzle, a middle end of the base and the housing are elastically hinged to each other by an elastic member, wherein the connection channel is connected to a middle portion of the housing.

5. The cleaner apparatus as claimed in claim 4, wherein the elastic member is a torsion spring.

6. The cleaner apparatus as claimed in claim 4, wherein the connection channel is a flexible hose which maintains its same channel cross section upon pivotable movement of the suction nozzle.

7. The cleaner apparatus as claimed in claim 6, wherein the flexible hose is formed in a telescopic configuration.

8. The cleaner apparatus as claimed in claim 1, wherein the suction nozzle comprises a rotary brush which is rotatably disposed at a dirt suction inlet.

9. The cleaner apparatus as claimed in claim 8, wherein the rotary brush is rotated by a brush motor disposed in the suction nozzle.

* * * * *